US011192127B2

(12) United States Patent
Manabe et al.

(10) Patent No.: US 11,192,127 B2
(45) Date of Patent: Dec. 7, 2021

(54) ELECTROSTATIC ATOMIZATION COATING APPARATUS

(71) Applicant: Taikisha Ltd., Tokyo (JP)

(72) Inventors: Keiji Manabe, Tokyo (JP); Shogo Noda, Tokyo (JP); Tatsuya Tanikawa, Kariya (JP)

(73) Assignee: Taikisha Ltd., Tokyo (JP)

( * ) Notice: Subject to any disclaimer, the term of this patent is extended or adjusted under 35 U.S.C. 154(b) by 0 days.

(21) Appl. No.: 16/637,850

(22) PCT Filed: Oct. 4, 2019

(86) PCT No.: PCT/JP2019/039372
§ 371 (c)(1),
(2) Date: Feb. 10, 2020

(87) PCT Pub. No.: WO2020/121631
PCT Pub. Date: Jun. 18, 2020

(65) Prior Publication Data

US 2020/0290063 A1 Sep. 17, 2020

(30) Foreign Application Priority Data

Dec. 11, 2018 (JP) ..... 2018-231533

(51) Int. Cl.
*B05B 5/025* (2006.01)
*B05B 5/16* (2006.01)

(52) U.S. Cl.
CPC ..... *B05B 5/025* (2013.01); *B05B 5/16* (2013.01)

(58) Field of Classification Search
USPC ..... 118/620–640, 313–315
See application file for complete search history.

(56) References Cited

U.S. PATENT DOCUMENTS 3,870,233 A * 3/1975 Wilhelm ..... B05B 12/14 239/692
4,613,075 A 9/1986 Owen
(Continued)

FOREIGN PATENT DOCUMENTS

CN 203778229 U 8/2014
JP S478712 B 3/1972
(Continued)

OTHER PUBLICATIONS

English Translation JP60000855A (Year: 1985).*

*Primary Examiner* — Yewebdar T Tadesse
(74) *Attorney, Agent, or Firm* — The Webb Law Firm

(57) ABSTRACT

In an electrostatic atomization coating apparatus including a nozzle head including a plurality of coating material ejection ports; a coating material chamber that is provided inside the nozzle head and to which a coating material is supplied via a coating material supply path, each of the coating material ejection ports being in communication with the coating material chamber via an individual branch coating material path; and a voltage application device that provides a potential difference between the nozzle head and an object to be coated, the coating material ejected from each of the coating material ejection ports via the coating material supply path, the coating material chamber, and the branch coating material path being brought into a charged state through application of a voltage by the voltage application device, an open/close valve device that opens and closes all of the branch coating material paths, or opens and closes a specific subset of a plurality of branch coating material paths out of all of the branch coating material paths is provided. Thus, it is possible to prevent external air from entering the nozzle head, and the coating material from leaking to the outside of the nozzle head.

11 Claims, 5 Drawing Sheets

(56) References Cited

U.S. PATENT DOCUMENTS

| | | | | |
|---|---|---|---|---|
| 5,813,608 | A * | 9/1998 | Yoshioka | B05B 3/1014 239/110 |
| 2006/0202067 | A1 * | 9/2006 | Mitsui | B05B 5/1608 239/690.1 |
| 2013/0026258 | A1 * | 1/2013 | Motozaki | B05B 5/0403 239/700 |
| 2018/0339303 | A1 | 11/2018 | Inoue et al. | |

FOREIGN PATENT DOCUMENTS

| | | | | |
|---|---|---|---|---|
| JP | 60000855 | A | * | 1/1985 |
| JP | S60855 | A | | 1/1985 |
| JP | S6041563 | A | | 3/1985 |
| JP | 4240654 | B2 | | 3/2009 |
| JP | 3200784 | U | | 11/2015 |
| JP | 2015188621 | A | | 11/2015 |
| JP | 20188253 | A | | 1/2018 |
| JP | 201838947 | A | | 3/2018 |

* cited by examiner

ELECTROSTATIC ATOMIZATION COATING APPARATUS

CROSS-REFERENCE TO RELATED APPLICATIONS

This application is the United States national phase of International Application No. PCT/JP2019/039372 filed Oct. 4, 2019, and claims priority to Japanese Patent Application No. 2018-231533 filed Dec. 11, 2018, the disclosures of which are hereby incorporated by reference in their entirety.

TECHNICAL FIELD

The present invention relates to an electrostatic atomization coating apparatus, and more particularly relates to an electrostatic atomization coating apparatus including: a nozzle head including a plurality of coating material ejection ports; a coating material chamber that is provided inside the nozzle head and to which a coating material is supplied via a coating material supply path, each of the coating material ejection ports being in communication with the coating material chamber via an individual branch coating material path; and a voltage application device that provides a potential difference between the nozzle head and an object to be coated, the coating material ejected from each of the coating material ejection ports via the coating material supply path, the coating material chamber, and the branch coating material path being brought into a charged state through application of a voltage by the voltage application device.

BACKGROUND ART

In this kind of electrostatic atomization coating apparatus (see Patent Document 1), the coating material in a charged state that has been ejected from the plurality of coating material ejection ports is atomized by the action of an electric field formed around the coating material ejection ports, and the atomized coating material in the charged state is electrostatically attracted to and flies to an object to be coated due to the potential difference between the object to be coated and the nozzle head, and thus is applied onto the surface of the object to be coated.

In the electrostatic atomization coating apparatus proposed in Patent Document 1, for the purpose of uniformly ejecting the coating material in the charged state from each of the plurality of coating material ejection ports regardless of the posture of the nozzle head (in other words, the orientation of the nozzle head), each branch coating material path extending from the coating material chamber inside the nozzle head to the respective coating material ejection ports is provided with a flow path resistor. Thus, in each of the branch coating material paths, the coating material passes through the corresponding branch coating material path against a certain passage resistance caused by the presence of the flow path resistor.

PRIOR ART DOCUMENTS

Patent Documents

Patent Document 1: JP 2018-8253A

DISCLOSURE OF THE INVENTION

Problem to be Solved by the Invention

Conventionally, in the case of an electrostatic atomization coating apparatus of this kind, even if each branch coating material path is provided with a flow path resistor as described in Patent Document 1, external air may enter the coating material chamber via some of the plurality of coating material ejection ports that are located at an upper portion, when the supply of the coating material to the coating material chamber is stopped in order to suspend or end the coating operation, depending on the posture of the nozzle head at the time. As a result of this, the coating material remaining in the coating material chamber may leak to the outside via the other coating material ejection ports located at a lower portion, and the leaked coating material may adhere to various portions, including the nozzle head, thus resulting in the issue of an increase in the burden of performing cleaning and maintenance.

Additionally, due to the influence of air that has entered the interior of the coating material chamber via some of the coating material ejection ports, the next instance of ejection of the coating material from the plurality of coating material ejection ports may be insufficient, thus resulting in improper coating of the object to be coated.

In view of these circumstances, a main object of the present invention lies in effectively solving the above-described problem through rational improvement.

Means for Solving Problem

A first characteristic feature of the present invention relates to an electrostatic atomization coating apparatus, the feature thereof lies in an electrostatic atomization coating apparatus including:

a nozzle head including a plurality of coating material ejection ports;

a coating material chamber that is provided inside the nozzle head and to which a coating material is supplied via a coating material supply path, each of the coating material ejection ports being in communication with the coating material chamber via an individual branch coating material path; and a voltage application device that provides a potential difference between the nozzle head and an object to be coated, the coating material ejected from each of the coating material ejection ports via the coating material supply path, the coating material chamber, and the branch coating material path being brought into a charged state through application of a voltage by the voltage application device, wherein an open/close valve device that opens and closes all of the branch coating material paths, or opens and closes a specific subset of a plurality of branch coating material paths out of all of the branch coating material paths is provided.

In this configuration, when an open/close valve device that opens and closes all of the branch coating material paths is provided as the open/close valve device, it is possible, by closing the open/close valve device so as to close all of the branch coating material paths when suspending or ending a coating operation, to reliably prevent external air from entering the coating material chamber via a subset of the coating material ejection ports, and the coating material remaining in the coating material chamber from leaking to the outside via another subset of the coating material ejection ports as a result of entry by air, regardless of the posture of the nozzle header at the time.

When an open/close valve device that opens and closes a specific subset of a plurality of branch coating material paths out of all of the branch coating material paths is provided as the open/close valve device, if a plurality of branch coating material paths corresponding to a plurality of coating material ejection ports into which air is highly likely to enter or from which the coating material is highly likely to leak out are selected as a specific subset of a plurality of branch coating material paths out of all of the coating material ejection ports, and the open/close valve device is provided for the selected subset, it is possible, by closing the open/close valve device so as to close the specific subset of a plurality of branch coating material paths when suspending or ending a coating operation, to reliably prevent external air from entering the coating material chamber via a subset of the coating material ejection ports, and the coating material remaining in the coating material chamber from leaking to the outside via another subset of the coating material ejection ports as a result of entry by air, regardless of the posture of the nozzle header at the time, as in the the above-described case.

Then, as a result of preventing the leaking out of the coating material remaining in the coating material chamber and the entry of external air into the coating material chamber in this manner, it is possible to effectively reduce the burden of performing cleaning and maintenance to remove the adhered coating material, and also to effectively avoid improper coating of the object to be coated caused by air that has entered the coating material chamber.

A second characteristic feature of the present invention specifies an embodiment suitable to implement the first characteristic feature, and the feature thereof lies in that the coating material ejection ports are disposed on the same circumference at a distal end face portion of the nozzle head so as to be equidistantly arranged in a row in a circumferential direction.

With this configuration, the coating material ejection ports are disposed so as to be equidistantly arranged in a row in the circumferential direction, and therefore, an electric field is uniformly formed without any imbalance around the coating material ejection ports even if electric field interference occurs between adjacent coating material ejection ports.

Accordingly, the coating material in the charged state that has been ejected from the plurality of coating material ejection ports is atomized uniformly, and thus, the coating quality of the object to be coated is enhanced.

A third characteristic feature of the present invention specifies an embodiment suitable to implement the second characteristic feature, and the feature thereof lies in that, at the distal end face portion of the nozzle head, a plurality of coating material ejection nozzles each including the coating material ejection port are provided on the same circumference so as to be equidistantly arranged in a row in a circumferential direction in a state in which the coating material ejection nozzles each protrude independently.

With this configuration, the coating material ejection nozzles are in a state in which they each protrude independently, and therefore, an electric field can be further effectively formed around the coating material ejection ports. This makes it possible to promote the atomization of the coating material in a charged state that has been ejected from the coating material ejection ports, and thus, the coating quality of the object to be coated can be further enhanced.

A fourth characteristic feature of the present invention specifies an embodiment suitable to implement the second characteristic feature, and the feature thereof lies in that an annular protruding portion is provided at the distal end face portion of the nozzle head, and the coating material ejection ports are disposed at the annular protruding portion so as to be equidistantly arranged in a row in a circumferential direction of the annular protruding portion.

With this configuration, the annular protruding portion at which the coating material ejection ports are formed is in a protruding state, and it is therefore possible to simplify the structure and the shape of the distal end face portion of the nozzle head, while effectively forming an electric field around the coating material ejection ports, as compared with a case where a plurality of coating material ejection nozzles each including a coating material ejection port are arranged at the distal end face portion of the nozzle head in a state in which the coating material ejection nozzles each protrude independently. Thus, it is possible to facilitate the production of the nozzle head.

A fifth characteristic feature of the present invention specifies an embodiment suitable to implement the second characteristic feature, and the feature thereof lies in that the coating material ejection ports are disposed on each of a plurality of concentric circumferences at the distal end face portion of the nozzle head so as to be equidistantly arranged in a row in a circumferential direction.

With this configuration, as long as a sufficient gap (i.e., radius difference) is secured between adjacent concentric circumferences, the effect (i.e., uniform atomization of the ejected charged coating material) realized by the second characteristic feature can be achieved for each of the ring-shaped rows of the coating material ejection ports formed on the circumferences.

Then, while achieving the effect of uniform atomization in such a manner, it is possible to increase the coating material ejection amount per unit time by forming a ring-shaped row of the coating material ejection ports on each of the plurality of concentric circumferences. Thus, the efficiency of the coating operation using the nozzle head can be increased.

A sixth characteristic feature of the present invention specifies an embodiment suitable to implement any one of the first to fifth characteristic features, and the feature thereof lies in that the open/close valve device includes one common valve body housed in the coating material chamber, and the common valve body performs an opening/closing operation between a valve closing position at which respective inlets of the branch coating material paths that are open to the coating material chamber are simultaneously closed, and a valve opening position at which the respective inlets of the branch coating material paths are simultaneously opened.

With this configuration, it is only necessary to provide one common valve body in order to open and close all of the branch coating material paths or a specific subset of a plurality of branch coating material paths out of all of the branch coating material paths. Accordingly, the structure of the nozzle head can be simplified, and thus, it is possible to facilitate the production of the apparatus, reduce the cost of the apparatus, and reduce the weight and the size of the nozzle head.

A seventh characteristic feature of the present invention specifies an embodiment suitable to implement the sixth characteristic feature, and the feature thereof lies in that a circumferential groove portion is formed inside the nozzle head as the coating material chamber, the inlets of the branch coating material paths are disposed on a bottom surface of the circumferential groove portion so as to be equidistantly arranged in a circumferential direction of the circumferential groove portion, the common valve body has an annular shape configured to be fitted to the circumferential groove portion, and the common valve body moves inside the circumferential groove portion in a piston-like manner in directions away from and toward the bottom surface of the circumferential groove portion, as the opening/closing operation between the valve closing position and the valve opening position.

With this configuration, it is only necessary to simply move one common valve body in a piston-like manner in order to open and close all of the branch coating material paths or a specific subset of a plurality of branch coating material paths out of all of the branch coating material paths. Accordingly, the driving structure of the valve body of the open/close valve device can be simplified, and thus, it is possible to further facilitate the production of the apparatus and further reduce the cost of the apparatus.

An eighth characteristic feature of the present invention specifies an embodiment suitable to implement the seventh characteristic feature, and the feature thereof lies in that a communication groove extending continuously from one end face side to another end face side of the annular shape of the common valve body is formed in an inner circumferential surface or an outer circumferential surface of the annular shape of the common valve body.

With this configuration, when the annular common valve body fitted to the circumferential groove portion is moved inside the circumferential groove portion in a piston-like manner in directions away from and toward the bottom surface of the groove portion, the coating material can be reciprocated between one end face side and the other end face side of the common valve body (i.e., between the region of the circumferential groove portion on the bottom side and the region on the side opposite to the bottom side) via the above-described communication groove so as to follow the piston-like movement. Thus, the piston-like opening/closing operation of the common valve body can be made smoother.

A ninth characteristic feature of the present invention specifies an embodiment suitable to implement the sixth characteristic feature, and the feature thereof lies in that a circumferential groove portion is formed inside the nozzle head as the coating material chamber, the inlets of the branch coating material paths are disposed on a bottom surface of the circumferential groove portion so as to be equidistantly arranged in a circumferential direction of the circumferential groove portion, the common valve body has an annular shape configured to be fitted to the circumferential groove portion, the common valve body includes a plurality of communication holes formed extending therethrough from one end face side to another end face side of the annular shape of the common valve body, the communication holes are disposed so as to be equidistantly arranged in a circumferential direction of the annular shape of the common valve body, at positions in one-to-one correspondence with the respective inlets of the branch coating material paths, and the common valve body pivots inside the circumferential groove portion in a circumferential direction of the circumferential groove portion, as the opening/closing operation between the valve closing position and the valve opening position.

In this configuration, the annular common valve body configured to be fitted to the circumferential groove portion is pivoted inside the circumferential groove portion in the circumferential direction of the circumferential groove portion, and the respective inlets of the branch coating material paths are brought into communication with the communication holes of the common valve body, whereby the respective inlets of the branch coating material paths are brought into communication with the circumferential groove portion serving as the coating material chamber via the communication holes, and the branch coating material paths are opened.

In addition, the respective inlets of the branch coating material paths are closed by the common valve body as a result of the annular common valve body pivoting inside the circumferential groove portion in the circumferential direction of the circumferential groove portion until the communication holes of the common valve body are displaced from the respective inlets of the branch coating material paths, whereby the branch coating material paths are closed.

In other words, with this configuration, it is only necessary to pivot the annular common valve body inside the circumferential groove portion in the circumferential direction of the circumferential groove portion in order to open and close all of the branch coating material paths or a specific subset of a plurality of branch coating material paths out of all of the branch coating material paths. Accordingly, it is possible to reduce the space required for the opening/closing operation of the common valve body between the valve closing position and the valve opening position, and thus, the size of the nozzle head can be further reduced.

A tenth characteristic feature of the present invention specifies an embodiment suitable to implement the first or second characteristic feature, and the feature thereof lies in that each of the branch coating material paths is provided with an individual open/close valve as the open/close valve device, and common operation means that simultaneously operates the open/close valves to open or close is provided.

In this configuration, the open/close valve provided in each of the branch coating material paths is operated to be simultaneously opened or closed by the common operation means, whereby the branch coating material paths are simultaneously opened/closed.

With this configuration, each of the branch coating material paths is provided with an individual open/close valve, and therefore, the degree of freedom in arrangement of the individual branch coating material paths in the nozzle head (in particular, the degree of freedom in arrangement of the respective inlets of the branch coating material paths in the coating material chamber) is increased, as compared with a case where a plurality of branch coating material paths are simultaneously opened/closed by one common valve body. Thus, design of the nozzle head is facilitated.

An eleventh characteristic feature of the present invention specifies an embodiment suitable to implement any one of first to tenth characteristic features, and the feature thereof lies in that the nozzle head is formed of an electrically insulating material or a slightly conductive material.

With this configuration, it is possible to prevent the occurrence of discharge between the nozzle head and another object that may be caused by the nozzle head and the other object approaching each other, and therefore, it is possible to enhance safety.

This also makes it possible to increase the strength of the electric field formed around the coating material ejection ports, and thus, the atomization of the charged coating material that is ejected from the coating material ejection ports can be further promoted.

BEST MODE FOR CARRYING OUT THE INVENTION

Figure 1:
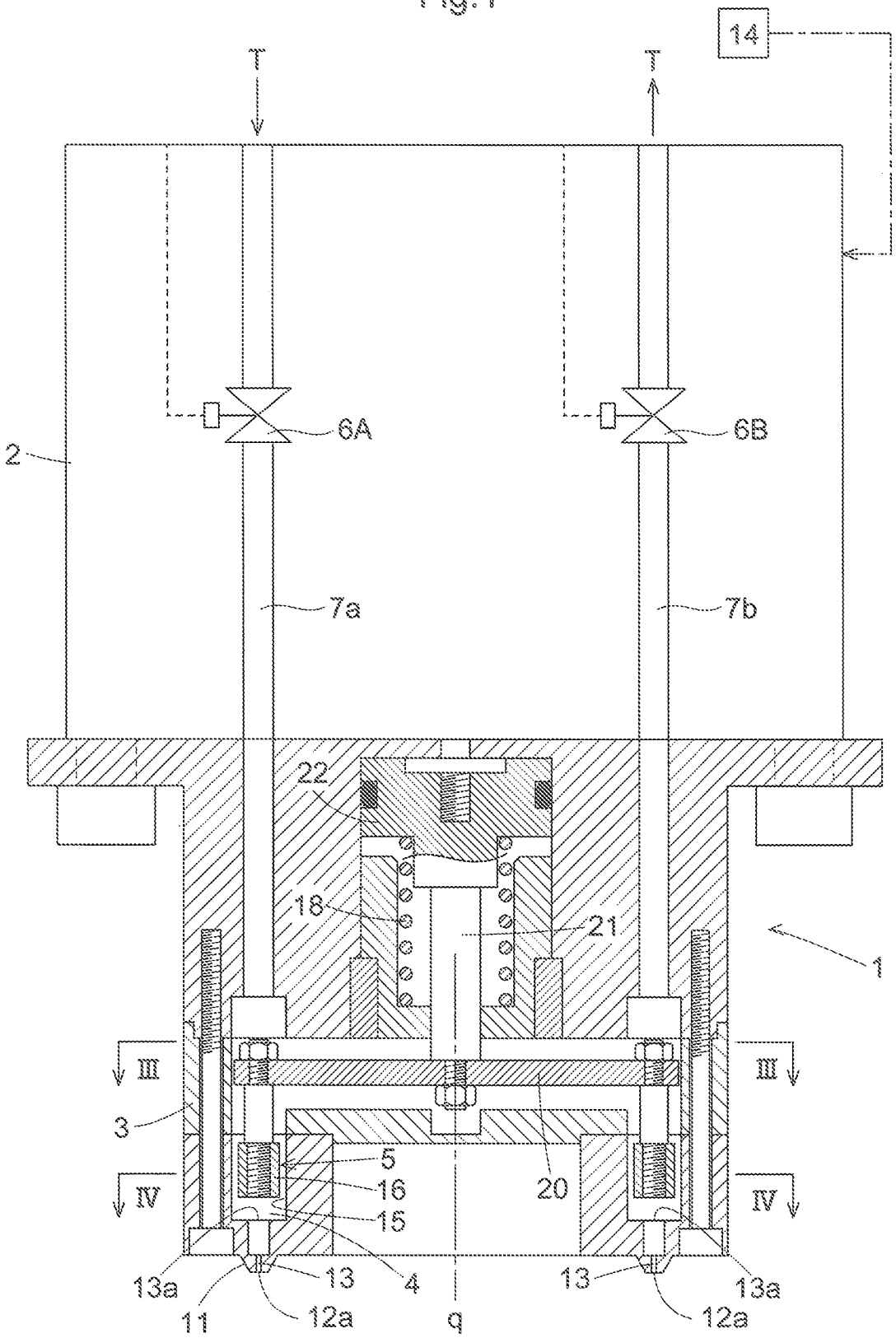
FIG. 1 is a vertical cross-sectional view of an electrostatic atomization coating apparatus.

FIG. 1 shows an electrostatic atomization coating apparatus 1 that coats an object to be coated by atomizing a coating material, and the electrostatic atomization coating apparatus 1 includes a main body portion 2 coupled to a distal end portion of a work arm of a coating robot, and a nozzle head 3 attached to a distal end of the main body portion 2.

In a coating operation using the electrostatic atomization coating apparatus 1, the coating operation is advanced while sequentially moving a target location of the coating material atomization on the object to be coated. At this time, the position and the posture of the electrostatic atomization coating apparatus 1 are sequentially adjusted by operations made by the coating robot such that the separation distance between the object to be coated and the nozzle head 3 is kept constant, and a state in which a distal end face portion of the nozzle head 3 is perpendicular to and directly faces the object to be coated is maintained.

A coating material chamber 4 is formed inside the nozzle head 3, and the coating material chamber 4 is disposed concentrically with the columnar nozzle head 3. In addition, an open/close valve device 5 is provided inside the nozzle head 3.

On the other hand, inside the main body portion 2, a coating material supply path 7*a* and a coating material feedback path 7*b* that extend to the coating material chamber 4 inside the nozzle head 3 are provided, and a supply-side switching valve 6A that opens and closes the coating material supply path 7*a* and a feedback-side switching valve 6B that opens and closes the coating material feedback path 7*b* are provided.

Figure 2:
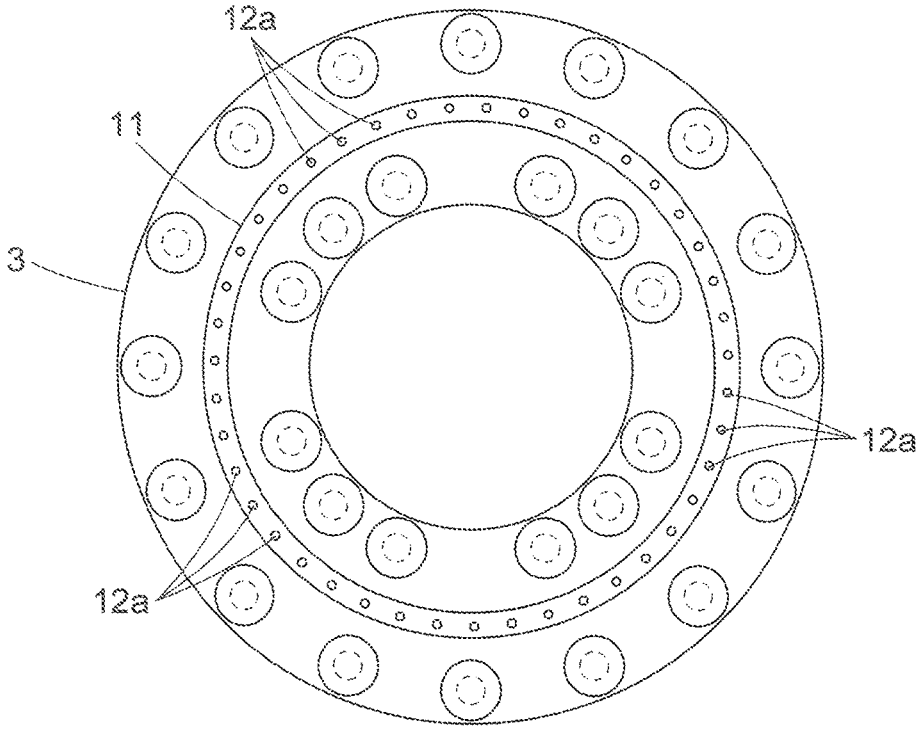
FIG. 2 is a front view of a distal end face portion of a nozzle head.

As shown in FIGS. 1 and 2, an annular protruding portion 11 disposed concentrically with the nozzle head 3 is formed in a distal end face portion of the nozzle head 3 that is made to directly face the object to be coated, and many coating material ejection ports 12*a* are formed in the annular protruding portion 11. The many coating material ejection ports 12*a* are disposed so as to be equidistantly arranged in a row in the circumferential direction of the annular protruding portion 11.

Figure 6:
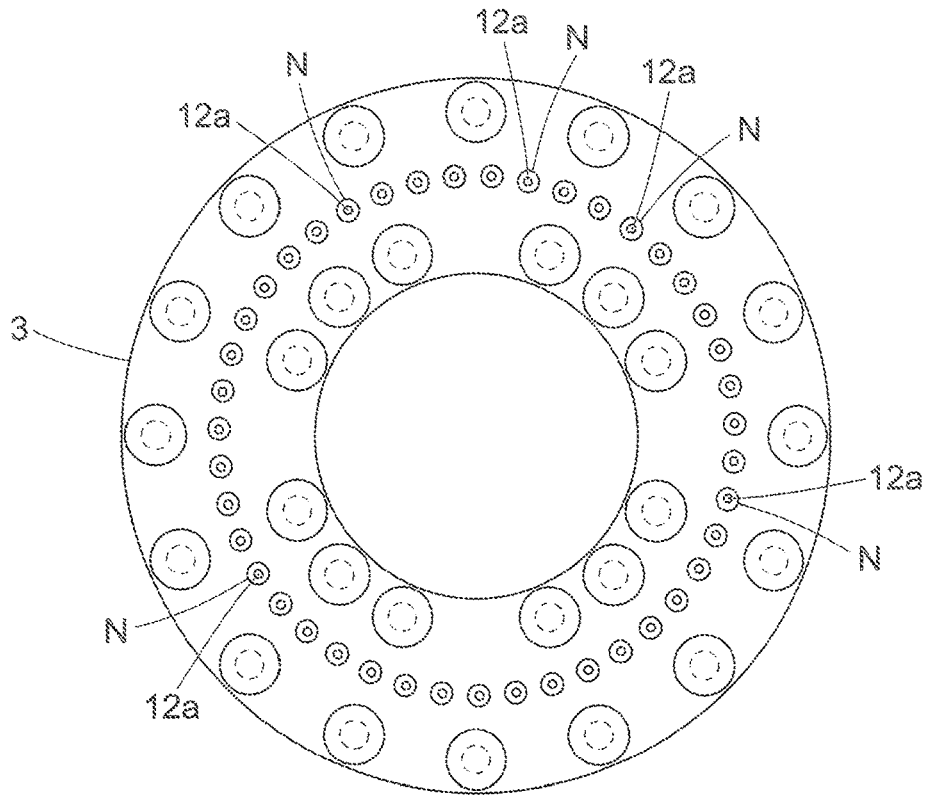
FIG. 6 is a front view of a distal end face portion of a nozzle head, showing an alternative embodiment.

Note that, at the distal end face portion of the nozzle head 3, a plurality of coating material ejection nozzles N each including a coating material ejection port 12*a* may be disposed on the same circumference so as to be equidistantly arranged in a row in the circumferential direction in a state in which the coating material ejection nozzles N each protrude independently as shown in FIG. 6, instead of providing the above-described annular protruding portion 11.

Each of the coating material ejection ports 12*a* is in communication with the coating material chamber 4 via an individual branch coating material path 13, and a coating material T that is supplied to the coating material chamber 4 via the coating material supply path 7*a* is ejected from the coating material ejection ports 12*a* via the branch coating material paths 13.

Meanwhile, in a state in which the supply-side switching valve 6A and the feedback-side switching valve 6B are open, the coating material T flows through the coating material supply path 7*a*, the coating material chamber 4, and the coating material feedback path 7*b*, and a portion of the flowing coating material T is fed from the coating material chamber 4 to the coating material ejection ports 12*a* via the branch coating material paths 13.

In the electrostatic atomization coating apparatus 1, a voltage application device 14 that provides a potential difference ΔV between the object to be coated, which is a coating target, and the nozzle head 3 is provided, and the coating material T that is ejected from the coating material ejection ports 12*a* via the coating material supply path 7*a*, the coating material chamber 4, and the branch coating material paths 13 is brought into a charged state as a result of a high voltage being applied by the voltage application device 14.

Due to the application of a high voltage by the voltage application device 14, an electric field is formed around the coating material ejection ports 12*a*, and the coating material T in the charged state that has been ejected from the coating material ejection ports 12*a*, is atomized by the action of the electric field formed around the coating material ejection ports 12*a*, as the so-called electrostatic atomization, and the atomized coating material T in the charged state is electrostatically attracted to and flies to the object to be coated due to the potential difference between the nozzle head 3 and the object to be coated, and is thus applied onto the surface of the object to be coated.

In the electrostatic atomization coating apparatus 1, many coating material ejection ports 12*a* are disposed at the distal end face portion of the nozzle head 3 so as to be equidistantly arranged in the circumferential direction. Accordingly, an electric field is formed uniformly without any imbalance around the coating material ejection ports 12*a* even if electric field interference occurs between adjacent coating material ejection ports 12*a*. Thus, the atomization of the coating material T in the charged state that has been ejected from the coating material ejection ports 12*a* is uniform, resulting in enhanced coating quality of the object to be coated.

In addition, it is possible to effectively prevent a situation where the atomization of the coating material T in the charged state that has been ejected from a subset of the coating material ejection ports 12*a* is insufficient due to imbalances in the electric field, whereby the insufficiently atomized coating material T adheres to the nozzle head 3.

Thus, the burden of performing cleaning and maintenance on the nozzle head 3 is reduced.

The open/close valve device 5 provided in the nozzle head 3 is a valve device that opens and closes the branch coating material paths 13 for the coating material ejection ports 12*a*, and the open/close valve device 5 is constantly biased to the valve opening side by a spring 18.

Figure 4:
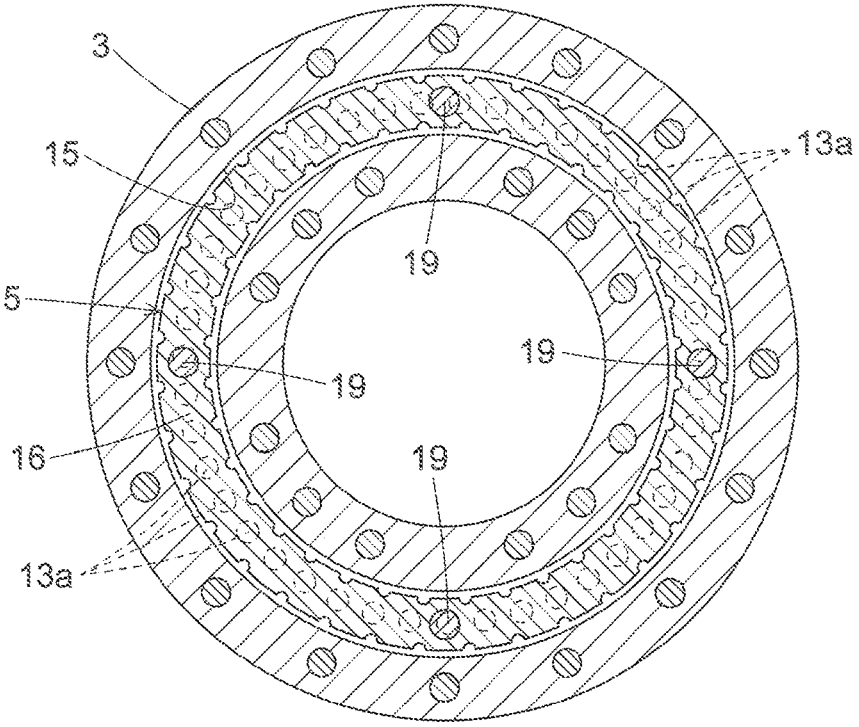
FIG. 4 is a cross-sectional view taken along the line IV-IV in FIG. 1.

As shown in FIGS. 1 and 4, inside the nozzle head 3, the coating material chamber 4 includes a circumferential groove portion 15 that is concentric with and has substantially the same diameter as the annular protruding portion 11, and the respective inlets 13*a* of the many branch coating material paths 13 are open to the circumferential groove portion 15 serving as the coating material chamber 4 on the bottom surface of the circumferential groove portion 15. The many inlets 13*a* are disposed so as to be equidistantly arranged in a row in the circumferential direction of the circumferential groove portion 15, in correspondence with a ring-shaped row of the coating material ejection ports 12*a*.

In this respect, a valve body 16 of the open/close valve device 5 is formed in an annular shape configured to be fitted to the circumferential groove portion 15, and is housed in a fitted state in the circumferential groove portion 15, and the annular valve body 16 serves as a common valve body for the many branch coating material paths 13.

Specifically, all of the branch coating material paths 13 are simultaneously closed as a result of the inlets 13*a* of all of the branch coating material paths 13 being closed by the annular common valve body 16 due to the annular common valve body 16 moving in a piston-like manner in the circumferential groove portion 15 to the bottom surface side of the circumferential groove portion 15, and all of the branch coating material paths 13 are simultaneously opened as a result of the inlets 13*a* of all of the branch coating material paths 13 being simultaneously opened by the annular common valve body 16 moving in a piston-like manner to the side away from the bottom surface of the circumferential groove portion 15.

That is, if the coating material supply path 7*a* and the coating material feedback path 7*b* are simply closed at the supply-side switching valve 6A and the feedback-side switching valve 6B when the atomization of the coating material onto the object to be coated is stopped in order to suspend or end the coating operation, depending on the posture of the nozzle head 3 at the time, external air may enter the coating material chamber 4 via the branch coating material paths 13 from a subset of coating material ejection ports 12*a* located at an upper portion out of the many coating material ejection ports 12*a*. As a result of this, the coating material T remaining in the coating material chamber 4 may leak to the outside from another subset of coating material ejection ports 12*a* located at a lower portion via the branch coating material paths 13.

In this respect, in the electrostatic atomization coating apparatus 1, when the atomization of the coating material onto the object to be coated is stopped, the open/close valve device 5 is operated to close, and all of the branch coating material paths 13 are closed by the annular common valve body 16. Thus, regardless of the posture of the nozzle head 3 at that time, the entry of external air via a subset of coating material ejection ports 12*a*, and the leaking out of the remaining coating material T via another subset of coating material ejection ports 12*a* as described above can be reliably prevented.

Figure 5:
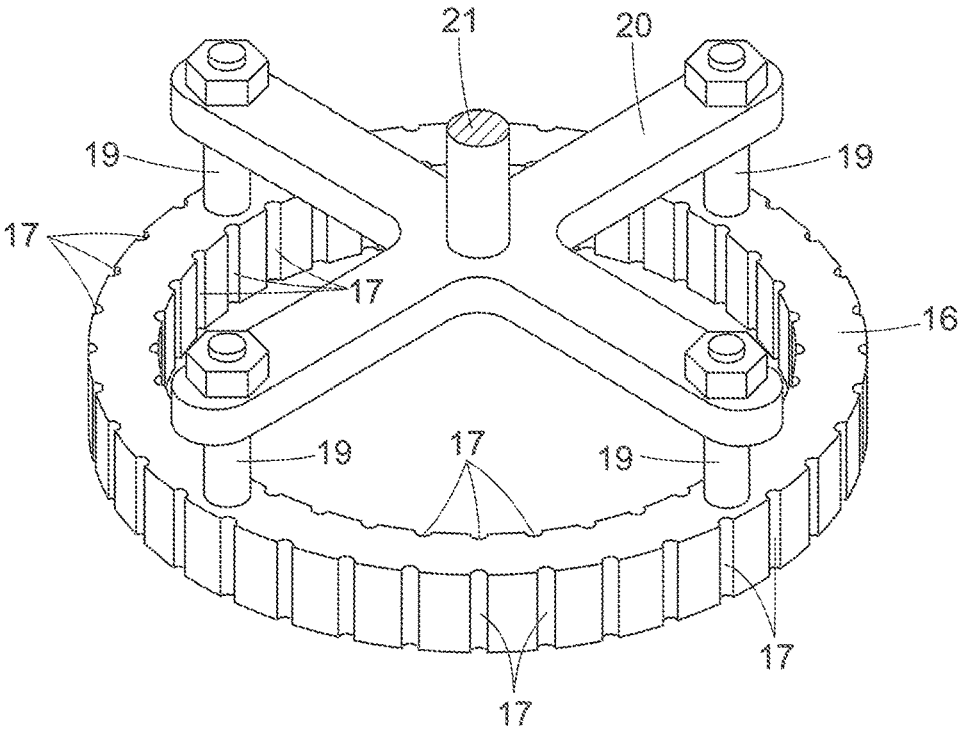
FIG. 5 is a perspective view of a common valve body.

As shown in FIGS. 4 and 5, many communication grooves 17 are formed in the outer circumferential surface and the inner circumferential surface of the annular shape of the common valve body 16, and the communication grooves 17 are formed extending from one end face of the annular common valve body 16 to the other end face thereof. On the one end face of the common valve body 16, the communication grooves 17 are open to a region on the bottom surface side of the circumferential groove portion 15 and, on the other end face of the common valve body 16, the communication grooves 17 are open to a region on the side opposite to the bottom surface of the circumferential groove portion 15 on.

In other words, in a state in which the open/close valve device 5 is open, the coating material T supplied to the coating material chamber 4 flows into the region on the bottom surface side of the circumferential groove portion 15 from the region on the side opposite to the bottom surface thereof via the many communication grooves 17. When the open/close valve device 5 performs an opening/closing operation in a piston-like manner, the coating material T moves between the region on the bottom surface side of the circumferential groove portion 15 and the region on the side opposite to the bottom surface thereof via the many communication grooves 17 so as to follow the opening/closing operation.

The annular common valve body 16 is coupled to a cross-shaped support member 20 via four coupling rods 19, and the four coupling rods 19 are equidistantly disposed in the circumferential direction of the circumferential groove portion 15.

The cross-shaped support member 20 is coupled to a valve operation piston 22 via a valve operation shaft 21 disposed on a central axis q of the nozzle head 3.

In other words, when the valve operation piston 22 is moved, through the application of air pressure for a valve-opening operation, to the distal end face side of the nozzle head 3 against the biasing force of the valve-opening biasing spring 18, the resulting parallel movement of the support member 20 and the four coupling rods 19 causes the annular common valve body 16 to operate so as to close the inlets 13*a* of all of the branch coating material paths 13.

Figure 3:
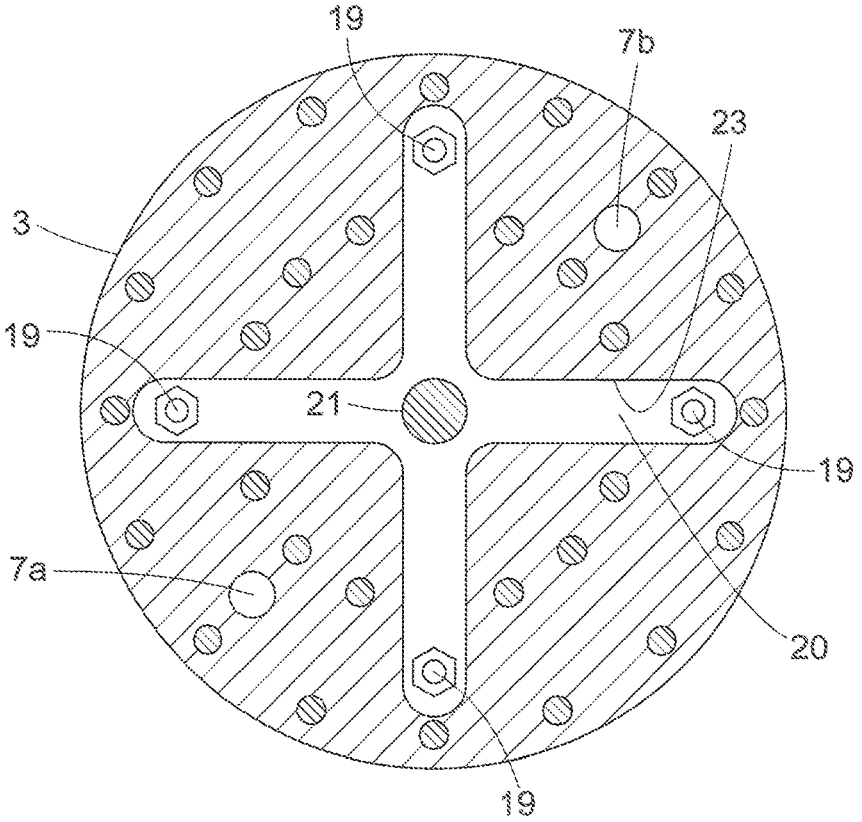
FIG. 3 is a cross-sectional view taken along the line III-III in FIG. 1.

As shown in FIG. 3, a guide hole 23 for the cross-shaped support member 20 is formed inside the nozzle head 3, and the guide hole 23 is formed in a cross shape as viewed in the direction of the central axis q of the nozzle head.

In other words, the cross-shaped support member 20 moves inside the cross-shaped guide hole 23 so as to reciprocate in the direction of the central axis q of the nozzle head.

The nozzle head 3 is formed of a non-conductive material or a slightly conductive material. Thus, even if the nozzle head 3 under application of a high voltage by the voltage application device 14 is inadvertently brought close to another object, it is possible to prevent the occurrence of discharge between the nozzle head 3 and the other object.

Alternative Embodiments

Next, alternative embodiments of the present invention will be listed.

The above-described embodiment has shown an open/close valve device 5 with a structure in which the respective inlets 13*a* of the branch coating material paths 13 are simultaneously opened/closed relative to the coating material chamber 4 through a piston-like opening/closing operation of the annular common valve body 16. However, instead of this, a structure shown in FIG. 7 may be adopted as the structure of the open/close valve device 5.

Figure 7:
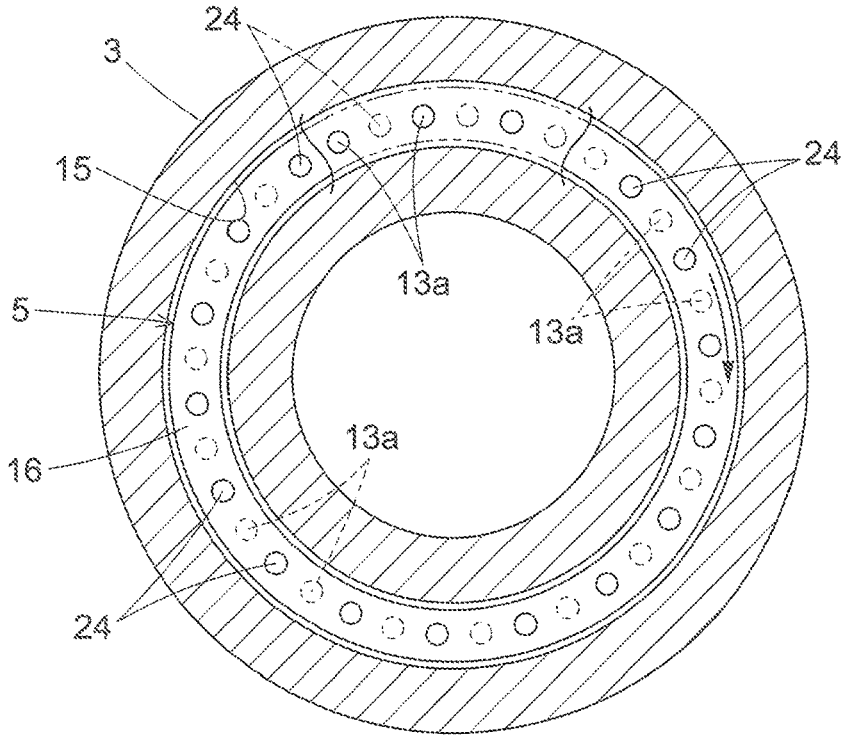
FIG. 7 is a structure diagram of an open/close valve device, showing an alternative embodiment.

That is, in the structure shown in FIG. 7, the annular common valve body 16 includes a plurality of communication holes 24 formed extending therethrough from one end face side to the other end face side of the annular shape of the common valve body 16, and the communication holes 24 are disposed so as to be equidistantly arranged in the circumferential direction of the annular shape of the common valve body 16, at positions in one-to-one correspondence with the respective inlets 13*a* of the branch coating material paths 13 that are open in the bottom surface of the circumferential groove portion 15.

Then, the annular common valve body 16 is configured to pivot inside the circumferential groove portion 15 in the circumferential direction by rotating about the central axis of the annular shape, as the opening/closing operation.

In other words, in the structure shown in FIG. 7, the common valve body 16 is operated to pivot until the respective inlets 13*a* of the branch coating material paths 13 are brought into communication with the communication holes 24 of the common valve body 16, whereby the respective inlets 13*a* of the branch coating material paths 13 are open to the coating material chamber 4 via the communication holes 24. Thus, the branch coating material paths 13 are simultaneously opened.

In addition, the common valve body 16 is operated to pivot until the communication holes 24 are displaced from the respective inlets 13*a* of the branch coating material paths 13, whereby the respective inlets 13*a* of the branch coating material paths 13 are closed by the common valve body 16. Thus, the branch coating material paths 13 are simultaneously closed.

Figure 8:
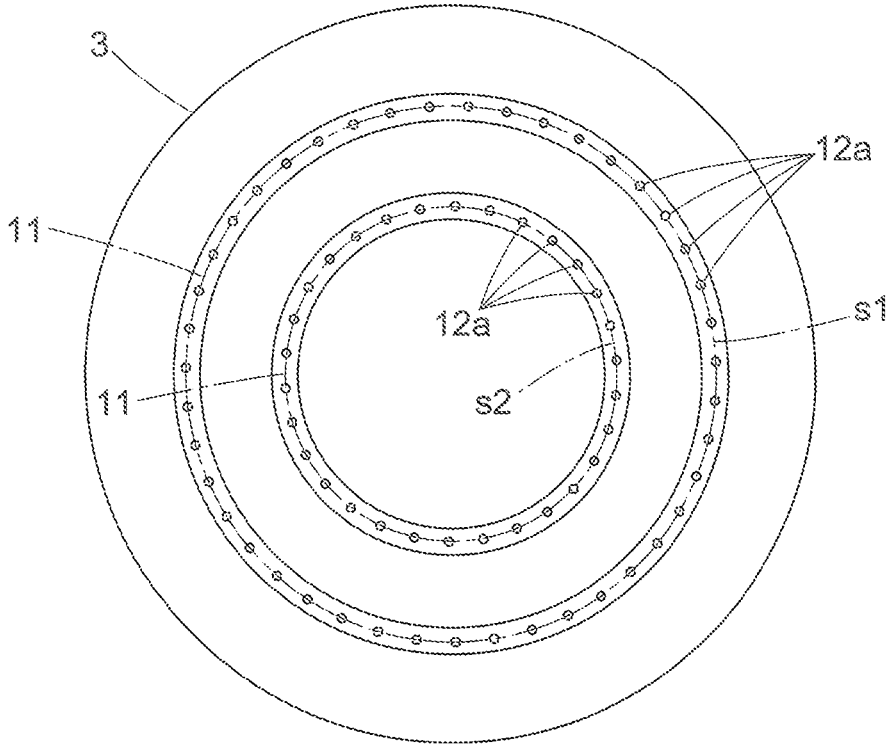
FIG. 8 is a front view of a distal end face portion of a nozzle head, showing an alternative embodiment.

The above-described embodiment has shown an example in which only one ring-shaped row of coating material ejection ports 12*a* in which the coating material ejection ports 12*a* are disposed on the same circumference so as to be equidistantly arranged in a row in the circumferential direction is provided at the distal end face portion of the nozzle head 3. However, instead of this, coating material ejection ports 12*a* may be disposed on each of a plurality of concentric circumferences s1 and s2 at the distal end face portion of the nozzle head 3 so as to be equidistantly arranged in a row in the circumferential direction as shown in FIG. 8, or in other words, a plurality of ring-shaped rows of coating material ejection ports 12*a* may be provided at the distal end face portion of the nozzle head 3 so as to be arranged concentrically.

The plurality of coating material ejection ports 12*a* may not necessarily be formed in the distal end face portion of the nozzle head 3 so as to be arranged in a ring-shaped row, and may be formed in the distal end face portion of the nozzle head 3 so as to be arranged in a matrix.

Figure 9:
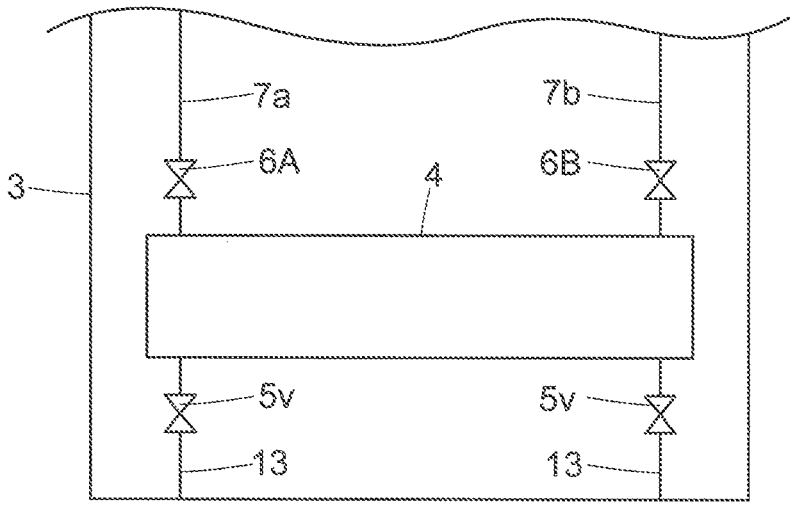
FIG. 9 is a schematic vertical cross-sectional view of a nozzle head, showing an alternative embodiment.

The above-described embodiment has shown an example in which a plurality of branch coating material paths 13 are simultaneously opened/closed by one common valve body 16. However, as schematically shown in FIG. 9, each of a plurality of branch coating material paths 13 that are to be opened/closed may be provided with an individual open/close valve 5*v* as the open/close valve device 5, and the open/close valves 5*v* may be operated to open/close by common operation means.

The above-described embodiment has shown an example in which all of the branch coating material paths 13 are simultaneously opened/closed by the open/close valve device 5. However, instead of this, a plurality of branch coating material paths 13 into which external air is highly likely to enter and from which the coating material is highly likely to leak out may be selected as a specific subset of a plurality of branch coating material paths out of all of the branch coating material paths 13, and only the selected specific subset of a plurality of branch coating material paths 13 may be simultaneously opened/closed by the open/close valve device 5.

INDUSTRIAL APPLICABILITY

An electrostatic atomization coating apparatus according to the present invention is applicable to coating of a variety of articles in various fields, such as coating of automobile bodies and automobile parts, or coating of casings of electric electronic products and building materials.

DESCRIPTION OF REFERENCE SIGNS

3: nozzle head
12*a*: Coating material ejection port
4: Coating material chamber
7*a*: Coating material supply path
T: Coating material
13: Branch coating material path
14: Voltage application device
5: Open/close valve device
N: Coating material ejection nozzle
11: Annular protruding portion
s1, s2: Circumference
16: Common valve body
15: Circumferential groove portion
17: Communication groove
24: Communication hole
5*v*: Open/close valve

The invention claimed is:

1. An electrostatic atomization coating apparatus comprising:

a nozzle head including a plurality of coating material ejection ports;

a coating material chamber that is provided inside the nozzle head and to which a coating material is supplied via a coating material supply path, each of the coating material ejection ports being in communication with the coating material chamber via an individual branch coating material path; and a voltage application device that provides a potential difference between the nozzle head and an object to be coated, the coating material ejected from each of the coating material ejection ports via the coating material supply path, the coating material chamber, and the branch coating material path being brought into a charged state through application of a voltage by the voltage application device, wherein a supply-side switching valve that opens and closes the coating material supply path is provided, wherein an open/close valve device that opens and closes all of the branch coating material paths, or opens and closes a specific subset of a plurality of branch coating material paths out of all of the branch coating material paths is provided, wherein the open/close valve device includes one common valve body housed in the coating material chamber, and the common valve body performs an opening/closing operation between a valve closing position at which respective inlets of the branch coating material paths that are open to the coating material chamber are simultaneously closed, and a valve opening position at which the respective inlets of the branch coating material paths are simultaneously opened.

2. The electrostatic atomization coating apparatus according to claim 1, wherein a circumferential groove portion is formed on a chamber-wall portion of the coating material chamber, the inlets of the branch coating material paths are disposed on a bottom surface of the circumferential groove portion so as to be equidistantly arranged in a circumferential direction of the circumferential groove portion, the common valve body has an annular shape configured to be fitted to the circumferential groove portion, and the common valve body moves inside the circumferential groove portion in a piston-like manner in directions away from and toward the bottom surface of the circumferential groove portion, as the opening/closing operation between the valve closing position and the valve opening position.

3. The electrostatic atomization coating apparatus according to claim 2, wherein a communication groove extending continuously from one end face side to another end face side of the annular shape of the common valve body is formed in an inner circumferential surface or an outer circumferential surface of the annular shape of the common valve body.

4. The electrostatic atomization coating apparatus according to claim 1, wherein a circumferential groove portion is formed on a chamber-wall portion of the coating material chamber, the inlets of the branch coating material paths are disposed on a bottom surface of the circumferential groove portion so as to be equidistantly arranged in a circumferential direction of the circumferential groove portion, the common valve body has an annular shape configured to be fitted to the circumferential groove portion, the common valve body includes a plurality of communication holes formed extending therethrough from one end face side to another end face side of the annular shape of the common valve body, the communication holes are disposed so as to be equidistantly arranged in a circumferential direction of the annular shape of the common valve body, at positions in one-to-one correspondence with the respective inlets of the branch coating material paths, and the common valve body pivots inside the circumferential groove portion in a circumferential direction of the circumferential groove portion, as the opening/closing operation between the valve closing position and the valve opening position.

5. An electrostatic atomization coating apparatus comprising:

a nozzle head including a plurality of coating material ejection ports;

a coating material chamber that is provided inside the nozzle head and to which a coating material is supplied via a coating material supply path, each of the coating material ejection ports being in communication with the coating material chamber via an individual branch coating material path; and a voltage application device that provides a potential difference between the nozzle head and an object to be coated, the coating material ejected from each of the coating material ejection ports via the coating material supply path, the coating material chamber, and the branch coating material path being brought into a charged state through application of a voltage by the voltage application device, wherein a supply-side switching valve that opens and closes the coating material supply path is provided, wherein an open/close valve device that opens and closes all of the branch coating material paths, or opens and closes a specific subset of a plurality of branch coating material paths out of all of the branch coating material paths is provided, and wherein the coating material ejection ports are disposed on the same circumference at a distal end face portion of the nozzle head so as to be equidistantly arranged in a row in a circumferential direction.

6. The electrostatic atomization coating apparatus according to claim 5, wherein, at the distal end face portion of the nozzle head, a plurality of coating material ejection nozzles each including the coating material ejection port are provided on the same circumference so as to be equidistantly arranged in a row in a circumferential direction in a state in which the coating material ejection nozzles each protrude independently.

7. The electrostatic atomization coating apparatus according to claim 5, wherein an annular protruding portion is provided at the distal end face portion of the nozzle head, and the coating material ejection ports are disposed at the annular protruding portion so as to be equidistantly arranged in a row in a circumferential direction of the annular protruding portion.

8. The electrostatic atomization coating apparatus according to claim 5, wherein the coating material ejection ports are disposed on each of a plurality of concentric circumferences at the distal end face portion of the nozzle head so as to be equidistantly arranged in a row in a circumferential direction.

9. The electrostatic atomization coating apparatus according to claim 5, wherein the open/close valve device includes one common valve body housed in the coating material chamber, and the common valve body performs an opening/closing operation between a valve closing position at which respective inlets of the branch coating material paths that are open to the coating material chamber are simultaneously closed, and a valve opening position at which the respective inlets of the branch coating material paths are simultaneously opened.

10. The electrostatic atomization coating apparatus according to claim 5, wherein each of the branch coating material paths is provided with an individual open/close valve as the open/close valve device, and common operation means that simultaneously operates the open/close valves to open or close is provided.

11. The electrostatic atomization coating apparatus according to claim 5, wherein the nozzle head is formed of an electrically insulating material or a slightly conductive material.

* * * * *